US008439984B2

(12) United States Patent
Hughes

(10) Patent No.: US 8,439,984 B2
(45) Date of Patent: May 14, 2013

(54) METHOD OF TREATING A FUEL TO REVERSE PHASE SEPARATION

(75) Inventor: Kevin Dewayne Hughes, Lovington, IL (US)

(73) Assignee: Central Illinois Manufacturing Company, Bement, IL (US)

( * ) Notice: Subject to any disclaimer, the term of this patent is extended or adjusted under 35 U.S.C. 154(b) by 671 days.

(21) Appl. No.: 12/386,133

(22) Filed: Apr. 14, 2009

(65) Prior Publication Data

US 2010/0257776 A1 Oct. 14, 2010

(51) Int. Cl.
*C10L 1/32* (2006.01)

(52) U.S. Cl.
USPC ..... 44/301; 44/302

(58) Field of Classification Search ..... 44/301, 44/302
See application file for complete search history.

(56) References Cited

U.S. PATENT DOCUMENTS

| | | | | |
|---|---|---|---|---|
| 2,365,009 | A | 12/1944 | Robertson | |
| 3,560,173 | A | 2/1971 | Coffey et al. | |
| 3,822,119 | A * | 7/1974 | Frech | 44/451 |
| 4,154,580 | A | 5/1979 | Landis | |
| 4,207,076 | A | 6/1980 | Bove et al. | |
| 4,328,004 | A * | 5/1982 | Globus | 44/412 |
| 4,384,872 | A | 5/1983 | Kester et al. | |
| 4,390,344 | A * | 6/1983 | Sweeney | 44/444 |
| 4,541,836 | A | 9/1985 | Derderian | |
| 4,561,861 | A | 12/1985 | Davis et al. | |
| 4,565,548 | A | 1/1986 | Davis et al. | |
| 4,599,088 | A | 7/1986 | Davis et al. | |
| 4,608,057 | A | 8/1986 | Davis et al. | |
| 5,688,295 | A | 11/1997 | Yang | |
| 6,190,427 | B1 | 2/2001 | Ahmed | |
| 2006/0101711 | A1 | 5/2006 | Vincent et al. | |

OTHER PUBLICATIONS

Gramajo, M. B. et al., 2004, Water tolerance and ethanol concentration in ethanol-gasoline fuels at three temperatures: *Energy and Fuels*, v. 18, pp. 334-337.

Gramajo, M.B. et al., 2004, Water tolerance and ethanol concentration in ethanol-gasoline fuels at three temperatures: Energy and Fuels, v. 18, pp. 334-337.

Malone, P. and French, R., 2005, Phase equilibria of ethanol fuel blends, Fluid Phase Equilibria, pp. 27-40.

Muzikova, Z. et al., 2008, Water tolerance of petro-ethanol blends: Goriva I Maziva, v. 47, pp. 34-53.

Owen, K. and Coley, T., 1995, Automotive Fuels Reference Book, 2nd edition, Society of Automotive Engineers, Warrendale, PA.

* cited by examiner

*Primary Examiner* — Cephia D Toomer
(74) *Attorney, Agent, or Firm* — Wood, Phillips, Katz, Clark & Mortimer

(57) ABSTRACT

A method of treating a liquid made up of an initial alcohol-blended fuel combined with water so that there is phase separation of an alcohol-water layer. A co-solvent is added to the first quantity of liquid and mixed with the first quantity of liquid to reverse the phase separation of the alcohol-water layer.

19 Claims, 1 Drawing Sheet

METHOD OF TREATING A FUEL TO REVERSE PHASE SEPARATION

BACKGROUND OF THE INVENTION

1. Field of the Invention

This invention relates to fuels, such as alcohol-blended fuels and, more particularly, to a method of reversing phase separation caused by exposure of alcohol-blended fuels to water.

2. Background Art

Alcohols have been used as additives in motor fuel to boost octane, oxygenate, extend fuel supply, replace ethers, and reduce the impact of fossil fuels on the carbon cycle.

One major problem with alcohol-blended fuels is their tendency to phase separate, when they are exposed to water, into a denser, alcohol-water layer, leaving a less dense, fuel layer depleted of octane rating and alcohol soluble hydrocarbons.

With alcohol-free fuels, water that is present is heavier and drops to the bottom of a container/tank. As long as a proper maintenance program is followed, the water level in the container/tank will never achieve the level of an intake for a pump that draws the fuel from the container/tank. By reason of their makeup, alcohol-blended fuels react differently than alcohol-free fuels in the presence of water.

Most common of the alcohol-blended fuels are ethanol-blended fuels. Ethanol is hygroscopic, meaning that it seeks out, and retains, water. At low water level concentrations, the ethanol is able to retain the water it has dissolved and remain associated with the fuel, whereby the fuel, water, and alcohol mixture remains stable and usable as a motor fuel. Once the water concentration exceeds a certain temperature-dependent threshold for the alcohol concentration, fuel-hydrocarbon content, and additives in the fuel, which typically contain alcohol as a major component, the ethanol and water phase separates from the fuel mixture. Under average temperature conditions in the United States a water content of 0.3% to 0.5% by volume is typical of a range within which phase separation occurs.

Generally, the alcohol-water layer will not support combustion in a conventional gasoline engine, such as those in vehicles, and, if introduced thereinto, may cause vehicle engine malfunction. At the same time, the upper fuel layer is depleted in octane rating and is likely out of spec for use as a motor fuel.

Because of its detrimental effects, the industry has for decades taken steps to avoid phase separation. Typically, additives have been introduced to the fuel to increase the water tolerance of the alcohol-blended fuel with the objective of avoiding phase separation. However, this approach has not prevented all cases of phase separation.

Currently, when phase separation does occur in a container/tank, the contents of the container/tank is pumped out and delivered to an appropriate facility for reconstitution. The container/tank is then cleaned preparatory to introducing a new supply of fuel.

At a filling station, phase separation has very significant economic consequences. The owner/operator thereof not only loses revenue from unsold fuel, but incurs the expense to haul the removed fuel away to be either reconstituted or discarded. Additionally, expenses are incurred in cleaning the emptied container/tank. The owner/operator must then additionally refill the container/tank while incurring even further losses by reason of the fact that the container/tank was out of commission while the above steps were carried out.

As phase separation occurs, the fuel can become an emulsion that is cloudy or hazy before denser material actually settles to the bottom of a container/tank. In the past, this condition has been treated with de-emulsifying agents to allow the emulsion to go back into the fuel mixture. This has commonly been accomplished with a nonionic surfactant of an alkanoic acid derivative.

SUMMARY OF THE INVENTION

In one form, the invention is directed to a method of treating a liquid made up of an initial alcohol-blended fuel combined with water so that there is phase separation of an alcohol-water layer. A co-solvent is added to the first quantity of liquid and mixed with the first quantity of liquid to reverse the phase separation of the alcohol-water layer.

In one form, the method further includes the step of predetermining an amount of co-solvent that will substantially completely reverse the phase separation of the alcohol-water layer with the first quantity of liquid.

In one form, the step of adding a co-solvent involves adding the predetermined amount of co-solvent.

In one form, the step of adding a co-solvent involves adding a co-solvent that is made up of at least one of: a) methanol; b) ethanol; c) proponal; and d) butanol.

In one form, the step of adding a co-solvent involves adding a co-solvent that is soluble in alcohol.

In one form, the step of predetermining the amount of co-solvent involves the steps of determining a volume of the phase separated alcohol-water layer in the first quantity of liquid and selecting a volume of the predetermined amount of co-solvent that is approximately the same as the volume of the phase separated alcohol-water layer in the first quantity of liquid.

In one form, the method of treating a first quantity of liquid further includes the steps of separating substantially all of the phase separated alcohol-water layer from the first quantity of liquid, to thereby leave a second quantity of liquid, combining the co-solvent and the phase separated alcohol-water layer, and thereafter adding the combined co-solvent and phase-separated alcohol-water layer to the second quantity of liquid in a container/tank to produce a third quantity of liquid.

In one form, the method of treating a first quantity of liquid further includes the step of agitating the combined co-solvent, phase-separated alcohol-water layer, and second quantity of liquid in the container/tank.

In one form, the container/tank has a top and bottom and the step of agitating the combined co-solvent, phase-separated alcohol-water layer, and third quantity of liquid involves drawing the third quantity of liquid from the bottom of the container/tank and reintroducing the drawn liquid from the bottom of the container/tank into the top of the container/tank.

In one form, the step of predetermining an amount of co-solvent is based upon a concentration of alcohol in the phase separated alcohol-water layer.

In one form, the alcohol-blended fuel has an initial octane rating and the co-solvent is added in an amount whereby an octane rating for the mixed first quantity of liquid and co-solvent is approximately equal to the initial octane rating.

In one form, the step of predetermining an amount of co-solvent takes into consideration a temperature of the first quantity of liquid.

In one form, the alcohol-blended fuel is an ethanol-blended fuel.

In one form, the step of adding a co-solvent involves adding a co-solvent that is made up of at least one of: a) tertiary butyl alcohol; and b) 1-butyl alcohol.

The invention is further directed to a method of treating a first quantity of liquid made up of an initial alcohol-blended fuel combined with water so that there is phase separation of an alcohol-water layer. A composition that increases water tolerance of the alcohol-blended fuel is added to, and mixed with, the first quantity of liquid to reverse the phase separation of the alcohol-water layer.

In one form, the method further includes the step of predetermining an amount of the composition that will substantially completely reverse the phase separation of the alcohol-water layer with the first quantity of liquid and the step of adding the composition involves adding the predetermined amount of the composition.

In one form, the step of adding the composition involves adding a composition that is soluble in alcohol.

In one form, the step of predetermining an amount of the composition is based upon a concentration of alcohol in the phase separated alcohol-water layer.

In one form, the alcohol-blended fuel has an initial octane rating and the composition is added in an amount whereby an octane rating for the mixed first quantity of liquid and the composition is approximately equal to the initial octane rating.

In one form, the step of predetermining an amount of the composition takes into consideration a temperature of the first quantity of liquid.

In one form, the method further includes the step of agitating the mixed composition and first quantity of liquid.

DETAILED DESCRIPTION OF THE PREFERRED EMBODIMENT

Unexpectedly, it has been found that phase separation that has occurred in any alcohol-blended fuel may be reversed by increasing the water tolerance of the fuel by the addition of a co-solvent. The co-solvent can be methanol, ethanol, any proponals, any butanols, and/or any other chemical or alcohol that increases water tolerance of alcohol-blended fuel.

It has been found that it is not critical whether these alcohols are derived from a biological source, a petrochemical source, or any other source by which the alcohol is produced or collected.

The use of butanols not only increases the water tolerance of an alcohol-blended fuel, but can also be used to reverse phase separation while maintaining the primary alcohol-to-fuel ratio. In the case of ethanol-blended fuels, especially E10, the addition of tertiary butyl alcohol, or 1-butyl alcohol, will allow the two phase separated layers to reassociate and restore the fuel to at least the same octane rating while preserving the ethanol-to-gasoline ratio.

It has also been found that phase separation of ethanol-blended fuels can be reversed by practicing the method herein with ethanol as the co-solvent.

Generally, the main difference between each co-solvent relates to the amount added to the phase-separated fuel to increase the water tolerance of the fuel to a sufficient level that upon mixing, a stable fuel-water-alcohol fuel is generated. It has further been found that it is not critical that the co-solvent be soluble in water, so long as it is soluble in the alcohol.

One exemplary process for reversing phase separation, according to the present invention, will now be described for an exemplary ethanol-blended fuel using a co-solvent that is n-butanol.

Figure 1:
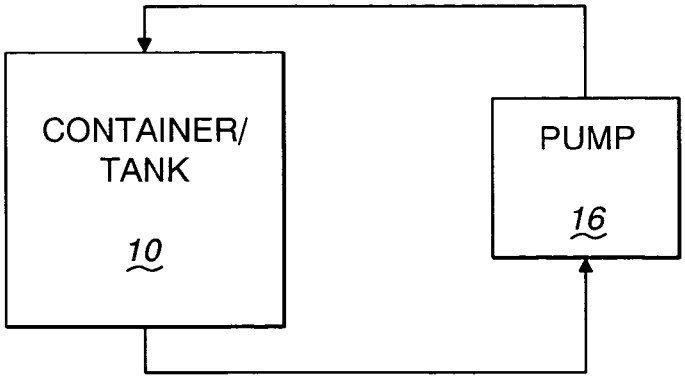
FIG. 1 is a schematic representation of a system through which the inventive method can be practiced.

As shown in FIG. 1, a container/tank 10 is provided for a first quantity of liquid that is made up of an initial alcohol-blended fuel, in this specific example ethanol-blended fuel, that is combined with water so that there is phase separation of an alcohol-water layer. This first step of providing the first quantity of liquid is depicted at block 12 in the flow diagram representation of the inventive method in FIG. 2. The container/tank 10 must have a sufficient capacity to handle the first quantity of liquid plus the required quantity of co-solvent.

Ideally, the inventive method is carried out shortly after phase separation has taken place to avoid too much growth of the alcohol-water layer.

Figure 2:
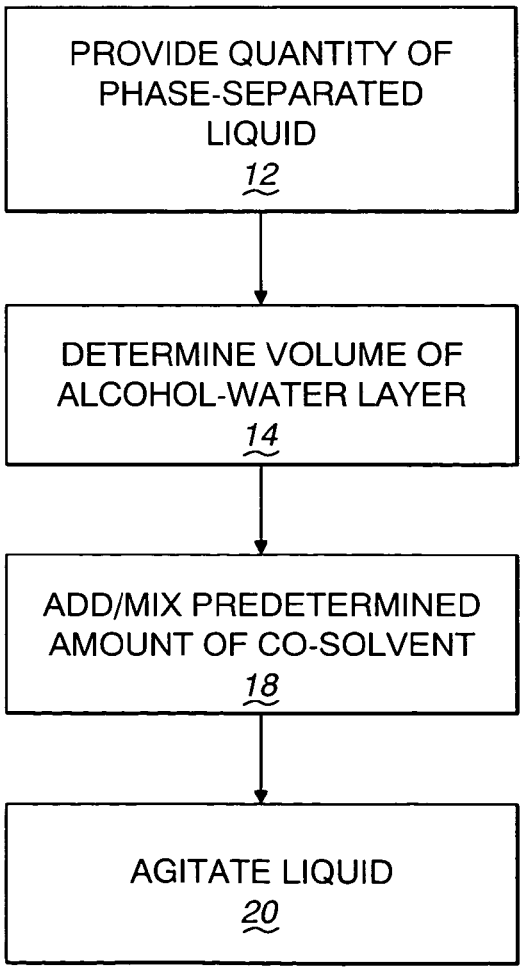
FIG. 2 is a flow diagram-representation of a method of treating a liquid, according to the invention, to reverse phase separation.

As shown at block 14 in FIG. 2, the volume of the alcohol-water layer in the container/tank 10 is determined in order to add an appropriate and predetermined amount of the co-solvent. The volume of the alcohol-water layer can be determined by any of a multitude of different methods known to those skilled in the art. In one preferred form, a pump 16, shown in FIG. 1, can be operated to draw the liquid from the bottom of the container/tank 10 and deliver the same to a graduated staging container/tank (not shown). The pumping continues until all of the alcohol-water layer has been removed. The graduations on the staging container/tank can then be used to determine the volume of alcohol-water.

As shown at block 18, a predetermined amount of the co-solvent is then selected and added to the first quantity of liquid either directly after the separated alcohol/water layer is reintroduced to the container/tank 10, or indirectly by combining the co-solvent with the separated alcohol-water layer before the same is reintroduced to the container/tank 10.

To determine the appropriate amount of co-solvent, a 1:1 ratio is used as a guide. That is, as a general rule, adding co-solvent with a volume equal to the volume of the separated alcohol-water layer will generally reverse the phase separation and cause the octane rating for the mixed first quantity of liquid and co-solvent to be approximately equal to the initial octane rating for the fuel. In most cases, a lesser volume of the co-solvent will be adequate. However, the 1:1 ratio generally builds in a margin of safety to account for any variances in the measurement of the volume of the alcohol-water layer and/or effects of temperature.

Temperature must be taken into account if a minimum amount of the co-solvent is to be added to achieve the aforementioned effects. The colder the temperature, the more co-solvent that is required to reverse phase separation.

Generally, if the co-solvent is added to the separated alcohol-water layer in a staging container/tank, the act of pumping the combined co-solvent and alcohol-water layer back into the primary container/tank 10 will normally effect the desired mixing action to reverse the phase separation and elevate the octane rating of the fuel in the first quantity of fuel combined with the co-solvent. As shown at block 20, additional agitation of the liquid after reintroduction of the alcohol-water layer back thereinto may be carried out. This is an optional step and is performed as necessary.

If this additional agitation is needed, it can be carried out in different manners. In one form, as shown in FIG. 1, the pump 16 can be used to draw a quantity of the liquid, made up of the first quantity of the liquid plus the co-solvent, from the bottom of the container/tank 10 to reintroduce the same at the top of the container/tank 10. This entire volume may be circulated one or more times. In one form, such recirculation occurs three times for complete mixing and agitation.

Alternatively, a fuel dump can be used to agitate and dilute the total alcohol concentration.

In one specific example, 1000 ml ethanol-blended gasoline with 10% ethanol at 70° F. was used. Water was added to the fuel at a volume of 5 ml to induce phase separation. The water and fuel were combined in a manner to maximize the volume of the phase separated alcohol-water layer. The volume of the alcohol-water layer was 17.5 ml at the bottom of the container/tank. Co-solvent was then added in 1 ml increments. After each increment was added, the fuel mixture was agitated and the reversal of phase separation inspected. The following table indicates the end volume of each of three different co-solvents that was required to effectively reverse the phase separation.

TABLE 1

| | n-butanol | t-butanol | Ethanol |
|---|---|---|---|
| Volume Added (ml) | 5 | 8 | 6 |
| % added | 28.57 | 45.71 | 34.29 |

The exact volume of the alcohol-water layer is variable and can grow over time with the addition of water and/or the stripping of additional alcohol from the top layer. As a general rule, the greater the alcohol concentration in the alcohol-water layer, the less co-solvent that is needed for reversal.

Given the guidelines set forth above, one skilled in this art can fine tune the method using minimal trial and error based upon the specific compositions, environmental conditions, etc.

The foregoing disclosure of specific embodiments is intended to be illustrative of the broad concepts comprehended by the invention.

The invention claimed is:

1. A method of treating a first quantity of liquid comprising an initial alcohol-blended fuel combined with water so that there is phase separation of an alcohol-water layer, the method comprising the steps of:

adding a co-solvent to the first quantity of liquid in which phase separation has already occurred; and mixing the co-solvent with the first quantity of liquid to reverse the phase separation of the alcohol-water layer, wherein the step of adding a co-solvent comprises adding a co-solvent that comprises at least one of: a) methanol; b)ethanol; c) proponal; and d) butanol.

2. The method of treating a first quantity of liquid according to claim 1 further comprising the step of predetermining an amount of co-solvent that will substantially completely reverse the phase separation of the alcohol-water layer in the first quantity of liquid based upon an analysis of a volume of the phase separated alcohol-water layer and the step of adding a co-solvent comprises adding the predetermined amount of co-solvent.

3. The method of treating a first quantity of liquid according to claim 1 wherein the step of adding a co-solvent comprises adding a co-solvent that is soluble in alcohol.

4. A method of treating a first quantity of liquid comprising an initial alcohol-blended fuel combined with water so that there is phase separation of an alcohol-water layer, the method comprising the steps of:

adding a co-solvent to the first quantity of liquid in which phase separation has already occurred;

mixing the co-solvent with the first quantity of liquid to reverse the phase separation of the alcohol-water layer; and predetermining an amount of co-solvent that will substantially completely reverse the phase separation of the alcohol-water layer in the first quantity of liquid based upon an analysis of a volume of the phase separated alcohol-water layer and the step of adding a co-solvent comprises adding the predetermined amount of co-solvent, wherein the step of predetermining the amount of co-solvent comprises the steps of determining a volume of the phase separated alcohol-water layer in the first quantity of liquid and selecting a volume of the predetermined amount of co-solvent that is approximately the same as the volume of the phase separated alcohol-water layer in the first quantity of liquid.

5. A method of treating a first quantity of liquid comprising an initial alcohol-blended fuel combined with water so that there is phase separation of an alcohol-water layer, the method comprising the steps of:

adding a co-solvent to the first quantity of liquid in which phase separation has already occurred;

mixing the co-solvent with the first quantity of liquid to reverse the phase separation of the alcohol-water layer;

separating substantially all of the phase separated alcohol-water layer from the first quantity of liquid, to thereby leave a second quantity of liquid;

combining the co-solvent and the phase separated alcohol-water layer; and thereafter adding the combined co-solvent and phase separated alcohol-water layer to the second quantity of liquid in a container/tank to produce a third quantity of liquid.

6. The method of treating a first quantity of liquid according to claim 5 further comprising the step of agitating the combined co-solvent, phase separated alcohol-water layer, and second quantity of liquid in the container/tank.

7. The method of treating a first quantity of liquid according to claim 6 wherein the container/tank has a top and bottom and the step of agitating the combined co-solvent, phase separated alcohol-water layer, and second quantity of liquid comprises drawing the third quantity of liquid from the bottom of the container/tank and reintroducing the drawn liquid from the bottom of the container/tank into the top of the container/tank.

8. The method of treating a first quantity of liquid according to claim 2 wherein the step of predetermining an amount of co-solvent comprises predetermining an amount of co-solvent based upon a concentration of alcohol in the phase separated alcohol-water layer.

9. The method of treating a first quantity of liquid according to claim 1 wherein the alcohol-blended fuel has an initial octane rating and the step of adding a co-solvent comprises adding a co-solvent in an amount whereby an octane rating for the mixed first quantity of liquid and co-solvent is approximately equal to the initial octane rating.

10. The method of treating a first quantity of liquid according to claim 2 wherein the step of predetermining an amount of co-solvent comprises predetermining an amount of co-solvent taking into consideration a temperature of the first quantity of liquid.

11. The method of treating a first quantity of liquid according to claim 1 wherein the alcohol-blended fuel is an ethanol-blended fuel.

12. The method of treating a first quantity of liquid according to claim 1 wherein the step of adding a co-solvent comprises adding a co-solvent that comprises at least one of: a) tertiary butyl alcohol; and b) 1-butyl alcohol.

13. A method of treating a first quantity of liquid comprising an initial alcohol-blended fuel combined with water so that there is phase separation of an alcohol-water layer, the method comprising the steps of:

adding to the first quantity of liquid in which phase separation has already occurred a composition that increases water tolerance of the alcohol-blended fuel; and mixing the composition with the first quantity of liquid to reverse the phase separation of the alcohol-water layer, wherein the alcohol-blended fuel has an initial octane rating and the step of adding the composition comprises adding the composition in an amount whereby an octane rating for the mixed first quantity of liquid and the composition is approximately equal to the initial octane rating.

14. The method of treating a first quantity of liquid according to claim 13 further comprising the step of predetermining an amount of the composition that will substantially completely reverse the phase separation of the alcohol-water layer in the first quantity of liquid based upon an analysis of a volume of the phase separated alcohol-water layer and the step of adding the composition comprises adding the predetermined amount of the composition.

15. The method of treating a first quantity of liquid according to claim 13 wherein the step of adding a composition comprises adding a composition that is soluble in alcohol.

16. The method of treating a first quantity of liquid according to claim 14 wherein the step of predetermining an amount of the composition comprises predetermining an amount of the composition based upon a concentration of alcohol in the phase separated alcohol-water layer.

17. The method of treating a first quantity of liquid according to claim 14 wherein the step of predetermining an amount of the composition comprises predetermining an amount of the composition taking into consideration a temperature of the first quantity of liquid.

18. The method of treating a first quantity of liquid according to claim 13 further comprising the step of agitating the mixed composition and first quantity of liquid.

19. A method of treating a first quantity of liquid comprising an initial alcohol-blended fuel combined with water so that there is phase separation of an alcohol-water layer, the method comprising the steps of:

adding to the first quantity of liquid in which phase separation has already occurred a composition that increases water tolerance of the alcohol-blended fuel in an amount of the composition taking into consideration a temperature of the first quantity of liquid; and mixing the composition with the first quantity of liquid to reverse the phase separation of the alcohol-water layer.

* * * * *